US009831559B2

(12) United States Patent
West et al.

(10) Patent No.: US 9,831,559 B2
(45) Date of Patent: Nov. 28, 2017

(54) LOW-PROFILE BLANKET ANTENNA

(71) Applicant: Rockwell Collins, Inc., Cedar Rapids, IA (US)

(72) Inventors: James B. West, Cedar Rapids, IA (US); Jiwon L. Moran, Marion, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 269 days.

(21) Appl. No.: 14/818,055

(22) Filed: Aug. 4, 2015

(65) Prior Publication Data

US 2017/0040702 A1 Feb. 9, 2017

(51) Int. Cl.

| | |
|---|---|
| ***H01Q 11/10*** | (2006.01) |
| *H01Q 9/04* | (2006.01) |
| *H01Q 9/42* | (2006.01) |
| *H01Q 21/20* | (2006.01) |

(52) U.S. Cl.

CPC ..... *H01Q 11/105* (2013.01); *H01Q 9/0407* (2013.01); *H01Q 9/42* (2013.01); *H01Q 21/205* (2013.01)

(58) Field of Classification Search

CPC ..... H01Q 11/105

USPC ..... 343/792.5

See application file for complete search history.

(56) References Cited

U.S. PATENT DOCUMENTS 7,907,098 B1 * 3/2011 West ..... H01Q 9/0442 343/700 MS

FOREIGN PATENT DOCUMENTS

GB 1302644 A * 1/1973 ..... H01Q 1/08

* cited by examiner

*Primary Examiner* — Graham Smith

(74) *Attorney, Agent, or Firm* — Angel N. Gerdzhikov; Donna P. Suchy; Daniel M. Barbieri

(57) ABSTRACT

An antenna array includes a flexible microstrip PCB feed layer and a plurality of radiating elements attached to the flexible PCB feed layer. The radiating elements comprise a Tau scalable log periodic array of low profile radiating elements for producing a monopole, end fire radiation pattern. Radiating elements include printed inverted F antenna elements and multi-arm puck elements for circular polarization. The antenna array is conformable to a curved surface. The radiating elements can be either integrated within a multi-layer flex or rigid flex PCB, or configured as individual elements that are die attached to a common ground plane flex circuit.

20 Claims, 13 Drawing Sheets

LOW-PROFILE BLANKET ANTENNA

BACKGROUND

Radio Frequency (RF) networked communication utilizes omnidirectional antennas; likewise, extended frequency tactical targeting network technology relies on omnidirectional antennas. Next generation Department of Defense directional communication systems require a dual mode directional/omnidirectional antenna array with 360° azimuthal coverage and high gain for anti-jam functionality that addresses anti-access, anti-denial (A2AD) threats.

Omnidirectional antennas in networked systems have reduced range due to low gain, broad beam width that makes the systems vulnerable to jamming, and are too large to mount on vehicles.

Ultra-wide band (UWB) conformal, low-profile, high gain, dual mode antennas configured to operate in a range of 1-10 GHz are unknown in the art. State of the art antenna radiating elements typically have a minimum size of one quarter of the wavelength at the lowest frequency ($\lambda/4$ at 1 GHz). Monopole radiating elements are too physically tall to operate at 1 GHz or less. Also, the need for co-located transmission (Tx) and reception (Rx) sectored arrays doubles the array size problem. Furthermore, traditional log periodic (LP) array concepts require a rigid, planar, non-conformal printed circuit board (PCB); for example, rigid LP array technology includes LP dipole arrays with a cardioid radiation pattern, LP monopole arrays with an end fire radiation pattern, and LP microstrip arrays with a cardioid pattern. Existing monopole LP arrays are tall at 1.0 GHz.

Balanced Antipodal Vivaldi Antenna (BAVA) MCA-BAVA circular arrays have adequate instantaneous bandwidth but also exhibit high Q nulls which deteriorate sectorial elevation coverage.

Consequently, it would be advantageous if an apparatus existed that is suitable for use as a low profile, UWB array antenna that is conformable to a surface.

SUMMARY

In one aspect, embodiments of the inventive concepts disclosed herein are directed to an antenna array that includes a flexible microstrip, stripline, or coplanar waveguide PCB feed layer and a plurality of radiating elements attached to the flexible microstrip PCB feed layer. The radiating elements may comprise an LP array of radiating elements that scale in size. The antenna array is conformable to a curved surface. The radiating elements can be either integrated within a multi-layer flex or rigid flex PCB, or configured as individual elements that are attached to a common ground plane flex circuit.

It is to be understood that both the foregoing general description and the following detailed description are exemplary and explanatory only and should not restrict the scope of the claims. The accompanying drawings, which are incorporated in and constitute a part of the specification, illustrate exemplary embodiments of the inventive concepts disclosed herein and together with the general description, serve to explain the principles.

BRIEF DESCRIPTION OF THE DRAWINGS

The numerous advantages of the inventive concepts disclosed herein may be better understood by those skilled in the art by reference to the accompanying drawings in which.

DETAILED DESCRIPTION

Reference will now be made in detail to the subject matter disclosed, which is illustrated in the accompanying drawings. The scope of the inventive concepts disclosed herein is limited only by the claims; numerous alternatives, modifications and equivalents are encompassed. For the purpose of clarity, technical material that is known in the technical fields related to the embodiments of the inventive concepts disclosed herein has not been described in detail to avoid unnecessarily obscuring the description.

The inventive concepts discussed herein may be more fully illuminated by U.S. Pat. No. 7,907,098, which is hereby incorporated by reference.

Figure 1:
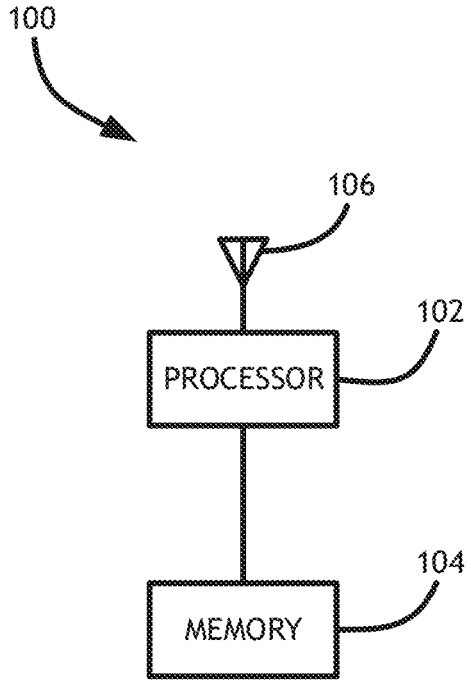
FIG. 1 shows a computer system suitable for implementing embodiments of the inventive concepts disclosed herein.

Referring to FIG. 1, a computer system 100 suitable for implementing embodiments of the inventive concepts disclosed herein includes a processor 102 and memory 104 connected to the processor 102 for embodying processor executable code. An antenna 106 is connected to the processor 102 through a feed layer in the antenna 106 configured to excite elements in the antenna 106 to produce a transmission signal or receive a signal through the antenna 106. Embodiments of an antenna 106 according to the present disclosure are useful for both directional and omnidirectional modes.

The antenna 106 according to some embodiments of the present disclosure comprises a flexible feed layer that conforms to a surface such as an aircraft or watercraft fuselage or the body of a car or truck. Substantially rigid radiating elements are affixed to the flexible feed layer at intervals. Sets of rigid radiating elements may be organized into receiving (Rx) sectors while other sets of radiating elements may be organized in the transmitting (Tx) sectors. Both directional and omnidirectional modes are possible in both Tx and Rx.

Figure 2:
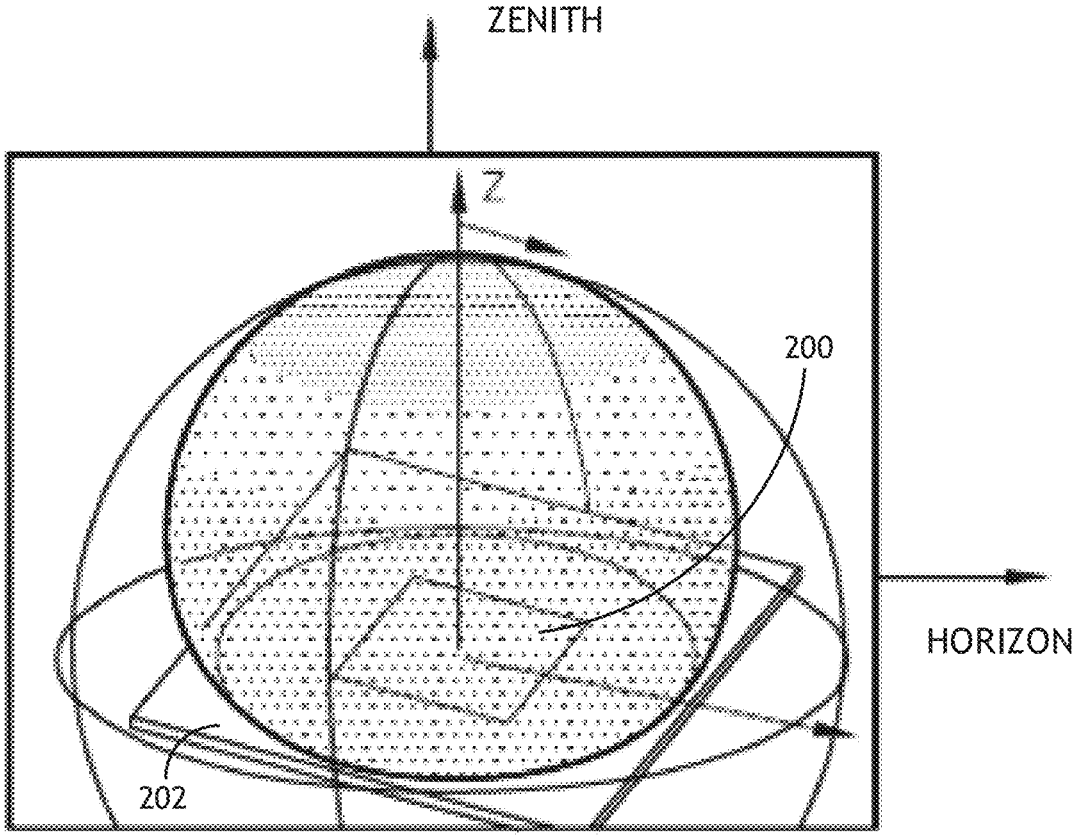
FIG. 2 shows a cardioid radiation pattern.
Figure 3:
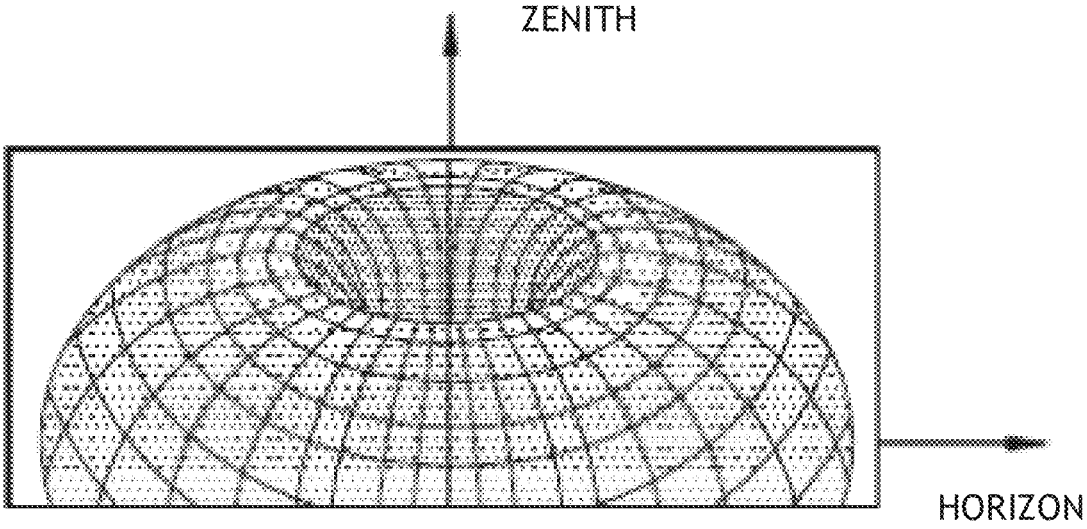
FIG. 3 shows a monopole, end fire radiation pattern.

Referring to FIGS. 2 and 3, a cardioid radiation pattern (FIG. 2) and a monopole radiation pattern (FIG. 3), also called an end fire radiation pattern are shown. It is desirable for the LP linear array to have "end fire" radiation for low angle radiation coverage for optimal near-the-horizon coverage. Individual elements within the LP array need monopole-like an "end fire" radiation pattern. Most printed radiating elements have a cardioid "cos(θ)" radiation pattern that does not work well at very low elevation angles. A LP configuration of radiating elements is useful for either a cardioid or monopole radiation pattern.

Figure 4:
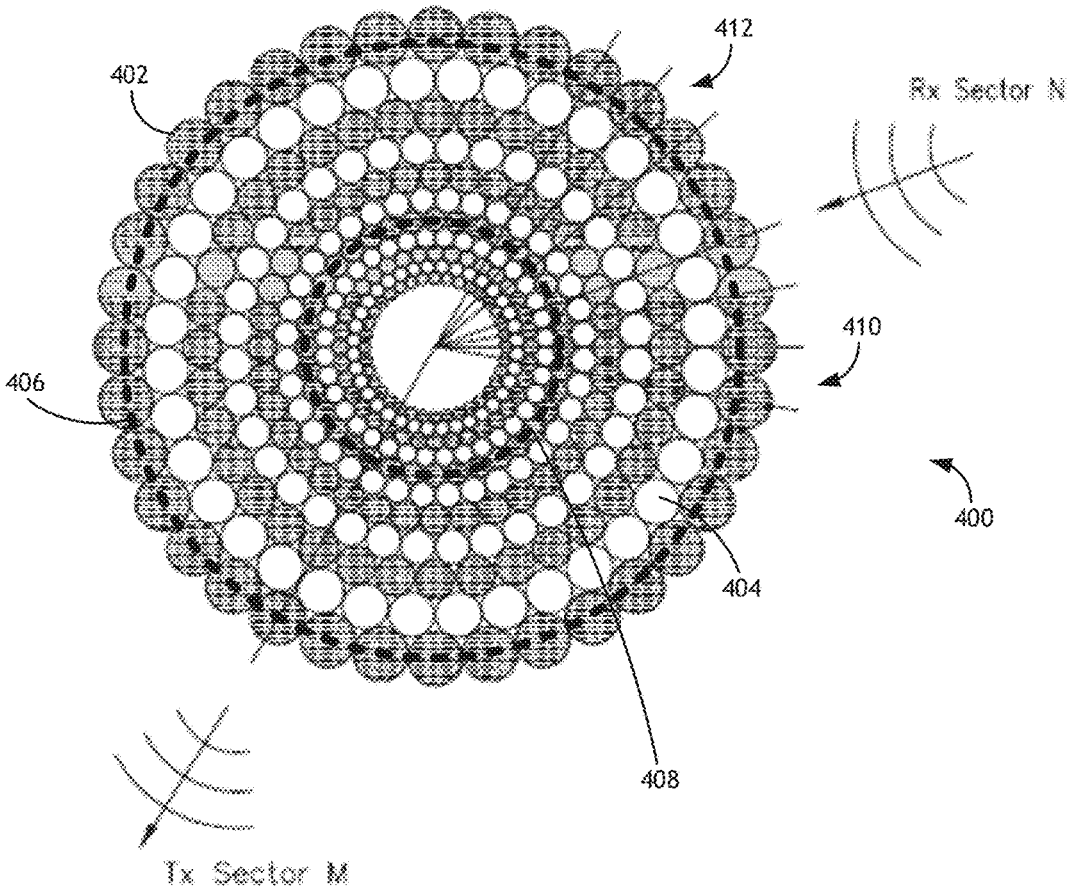
FIG. 4 shows a top view of an array of radiating elements according to one embodiment of the inventive concepts disclosed herein.

Referring to FIG. 4, a top view of an array 400 according to one embodiment of the inventive concepts disclosed herein is shown. The radiating elements are organized into an active region bounded by 406 and 408. The operative frequency of the active region between 406 and 408 is defined by the bandwidth of the radiating elements within the region between 406 and 408. In one exemplary embodiment, the band ratio of the active region is defined by the radius of the outer perimeter (406) and the inner radius (408). Bandwidth is limited by the operating bandwidth of the radiating elements within inner and outer radii. LP dimensional migration of the active region across the array enables UWB operation. An additional Omni-directional radiating element 402 and 404 may be positioned in the direct center of the array 400 to realize simultaneous directional and omnidirectional Tx and Rx for increased coverage.

In some embodiments of the present disclosure, the array 400 is configured in a plurality of LP linear array sectors 410 and 412. Sectors 410 and 412 may be defined by the relative orientations of radiating elements 402 and 404. Further, radiating elements 402 and 404 may define Rx sectors 410 and Tx sectors 412, each specifically configured for Rx and Tx operations respectively. Beam width may remain constant because the active region between 406 and 408 migrates across the array as a function of wavelength. Grating lobes are not a concern and radar cross-section is low because arrays 400 according to embodiments of the present disclosure have no Bragg scattering.

The pattern of radiating elements 402 and 404 may be mapped accurately onto a curved surface to account for the curvature and produce an array having a desirable shape.

Radiating elements 402 and 404 may comprise printed microstrip antennas, inverted F antennas (IFA), printed inverted F antennas (printed IFA), planar inverted F antennas (PIFA), monopole antennas, circular disk (C-disk) antennas, half-loop antennas, slot cavity elements, or any other radiating element generally conforming to the features and limitations set forth herein.

Figure 14:
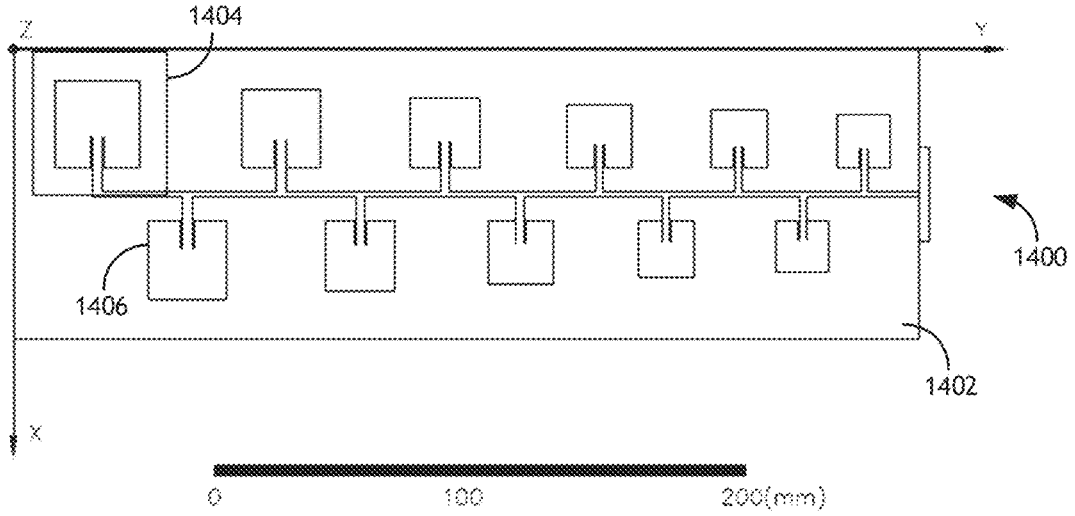
FIG. 14 shows a top view of an array of radiating elements according to one embodiment of the inventive concepts disclosed herein.

In one embodiment, an array 400 of microstrip radiating elements 402 and 404, such as shown in FIG. 14, may comprise a stepped impedance feed and have a return loss of less than −8.6 dB over a 2.04 GHz to 3.3 GHz frequency range while exhibiting a cardioid radiation pattern characteristic of higher elevation angle coverage. In another embodiment comprising an array 400 of planar inverted F antennas, such as shown in FIGS. 8-12, the array 400 may have a return loss of less than −10 dB in the range of 0.9 GHz to 2.69 GHz while exhibiting an end fire radiation pattern characteristic of optimized low elevation angle coverage. Further, an array 400 according to embodiments of the inventive concepts disclosed herein may have variable radiation properties depending on the desired operating frequency. Specifically, radiation properties may change above 2.5 GHz.

In some embodiments, impedance bandwidth may be greater than the fundamental mode radiation patterns of the radiating elements 402 and 404 that comprise the array 400, suggesting that a higher mode of operation may be realized at the upper band limits to broaden the overall operating bandwidth of the array 400, but with a change in radiation pattern and the antenna transitions into the next higher mode of radiation.

Figure 5:
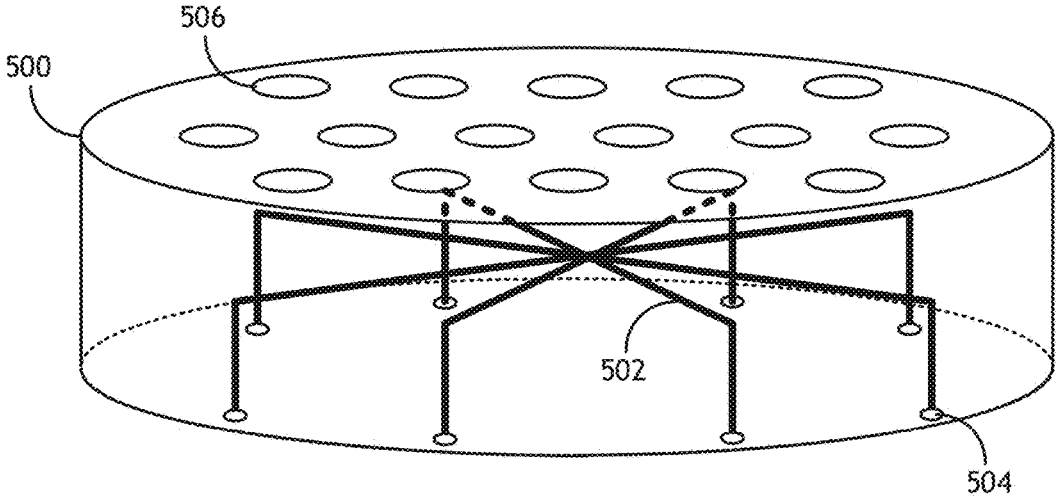
FIG. 5 shows a perspective view of a multi-arm radiating element according to one embodiment of the inventive concepts disclosed herein.

Referring to FIG. 5, a perspective view of a multi-arm radiating element 500 such as an inverted F puck is shown. In such a radiating element 500, a plurality of antenna arms 502 are each connected to a flexible feed layer through at least one feed connection element 504, and are encased in a low-loss dielectric material. Multi-arm bent monopoles are used to raise the terminal port impedance of the radiating element 500 closer to 50 ohms to compensate for its extremely short effective height. The radiating element 500 may have a local ground plane metallurgically attached to the flexible feed layer. The radiating element 500 may also have a plurality of air holes 506 to lower the effective dielectric constant of the material and reduce weight. At least one of the ports 504 are excited, with the remainder of the ports shorted, or multiple ports 504 can be excited for different radiation patterns to that of the vertical polarized monopole.

The radiating element 500 is a single "puck" radiating element in an array. Each radiating element 500 contains multiple antenna arms 502 to maximize impedance matching by zeroing the reactance part of the impedance and matching the resistance part of the impedance to desired impedance such as 50 ohm RF circuit.

Figure 13:
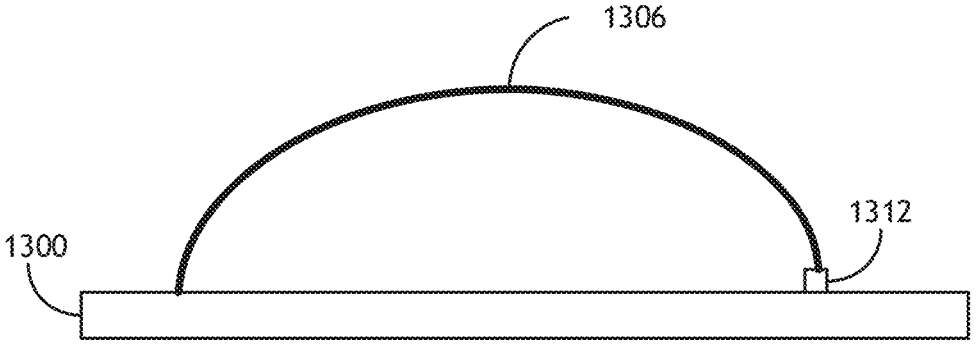
FIG. 13 shows a side view of a radiating element according to an embodiment of the inventive concepts disclosed herein.

Ground driven "puck" ½ loops, such as shown in FIG. 13, are possible for horizontal polarization radiation. Additionally, LP circularly polarized radiation is possible with multiple feed connection elements 504 corresponding to various antenna arms 502 within the radiating element 500.

In some embodiments, the radiating element 500 may comprise minimal dielectric encasement to minimize dielectric loading, by creating regions of air within the dielectric structure. Further, ferrite materials and metamaterials may be useful for dielectric encasement for further electric miniaturization.

Figure 6:
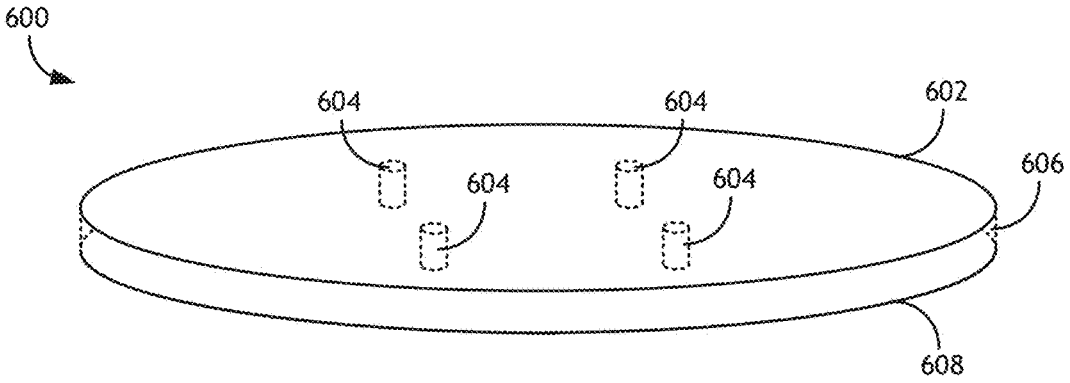
FIG. 6 show a perspective view of a circular disk radiating element according to one embodiment of the inventive concepts disclosed herein.

Referring to FIG. 6, a perspective view of a C-disk element 600 according to one embodiment of the inventive concepts disclosed herein is shown. The C-disk element 600 is a PCB compatible antenna element. In one embodiment, the C-disk element 600 comprises an upper metal plate 602 connected to a lower metal plate 608 through a plurality of inductive posts 604. The upper metal plate 602 is separated from the lower metal plate 608 by a dielectric material 606. The dielectric material 606 may have a dielectric constant of approximately 2.5.

The C-disk element 600 may comprise four inductive posts 604 with diameters approximately 0.0044 of the operational wavelength of the radiating element 600. Further, the radiating element 600 may have a diameter of approximately 0.25 and a height of approximately 0.018 of the operational wavelength of the radiating element 600.

The C-disk element 600 has a very low profile and produces a monopole radiation pattern. The low profile of a ground driven C-disk element 600 minimizes destructive interference for either forward or backward mode radiation in the LP array. Inductive loading of C-disk elements 600 allows very small array structures that are readily LP scalable.

Figure 7A:
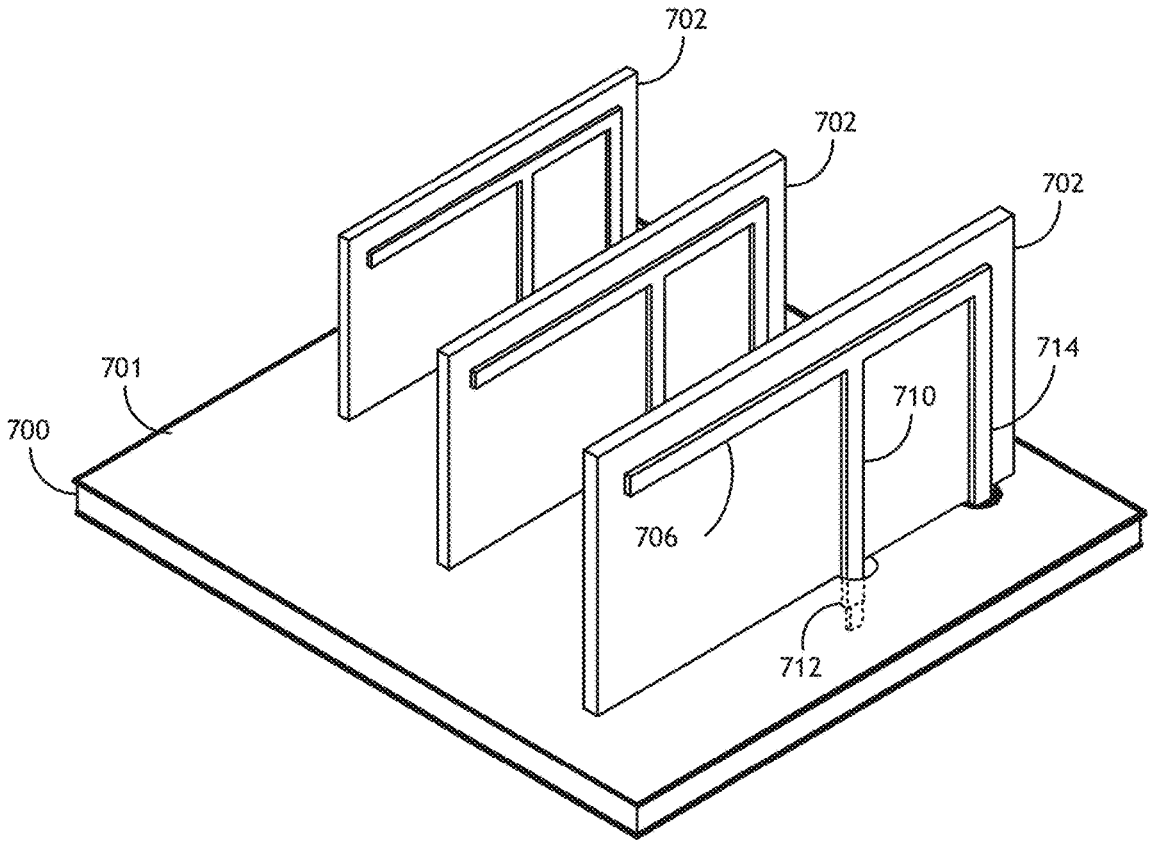
FIG. 7A shows a perspective view of a portion of a radiating element including printed inverted F antennas.
Figure 7B:
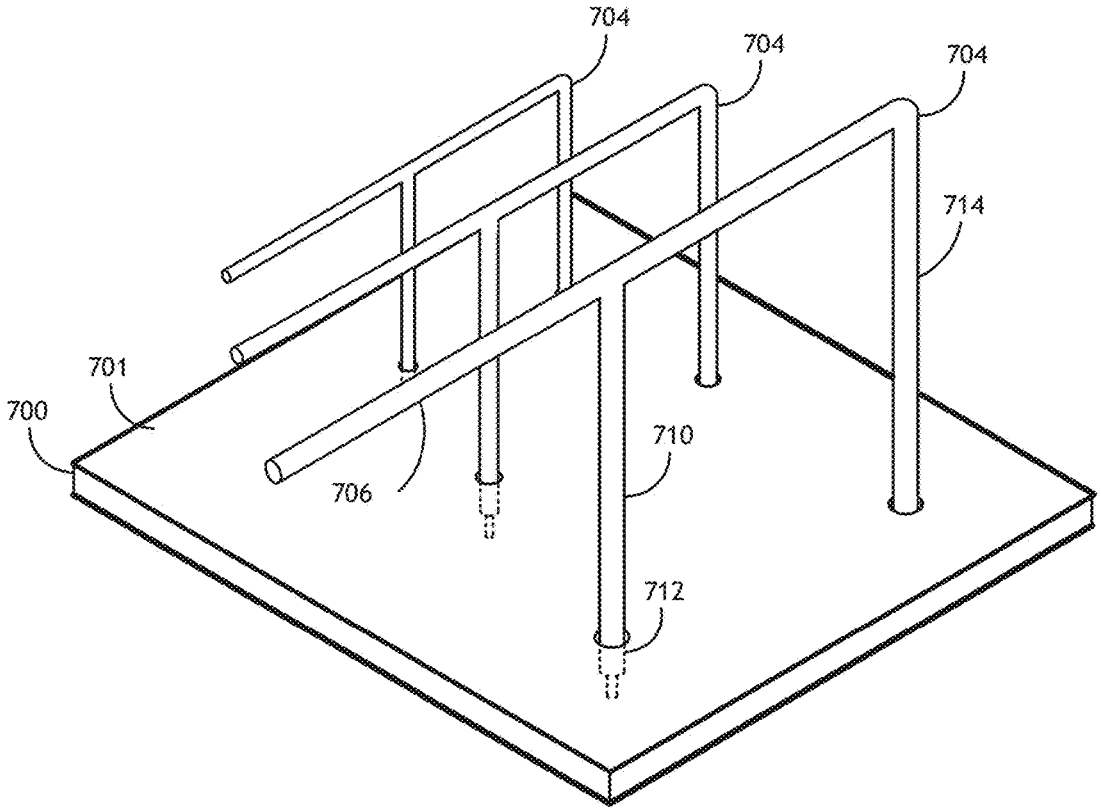
FIG. 7B shows a perspective view of a portion of a radiating element including inverted F antennas.

Referring to FIGS. 7A and 7B, perspective views of a portion of a radiating element including IFAs or printed IFAs are shown. In one embodiment, a radiating element comprises a dielectric substrate 700 over a ground plane 701 and a plurality of printed IFAs 702. The width of a planar IFA lines control impedance matching without necessarily utilizing the width of the planar portion of the PIFA 702.

In another embodiment, a radiating element comprises a dielectric ground plane 701 over a substrate 700 and a plurality of printed IFAs 704. Each of the plurality of printed IFAs 702 or IFAs 704 comprises a resonator 706 connected to the ground plane 701 through a shorting element 714, and connected to a feed layer through a feed element 710. In at least one embodiment, the feed element 710 connects to the feed layer via a coaxial feed 712. The coaxial feed 712 may be insulated from the ground plane 701 with as insulator such as polytetrafluoroethylene (PTFE, currently sold as Teflon by DuPont Co. IFAs have demonstrated return loss less than −9.1 dB over a 1.07 GHz to 2.46 GHz frequency range.

In at least one embodiment, the dielectric substrate 700 comprises a dielectric material having a dielectric constant of approximately 2.2 and thickness of approximately 1.575 mm (62 mil).

Figure 8A:
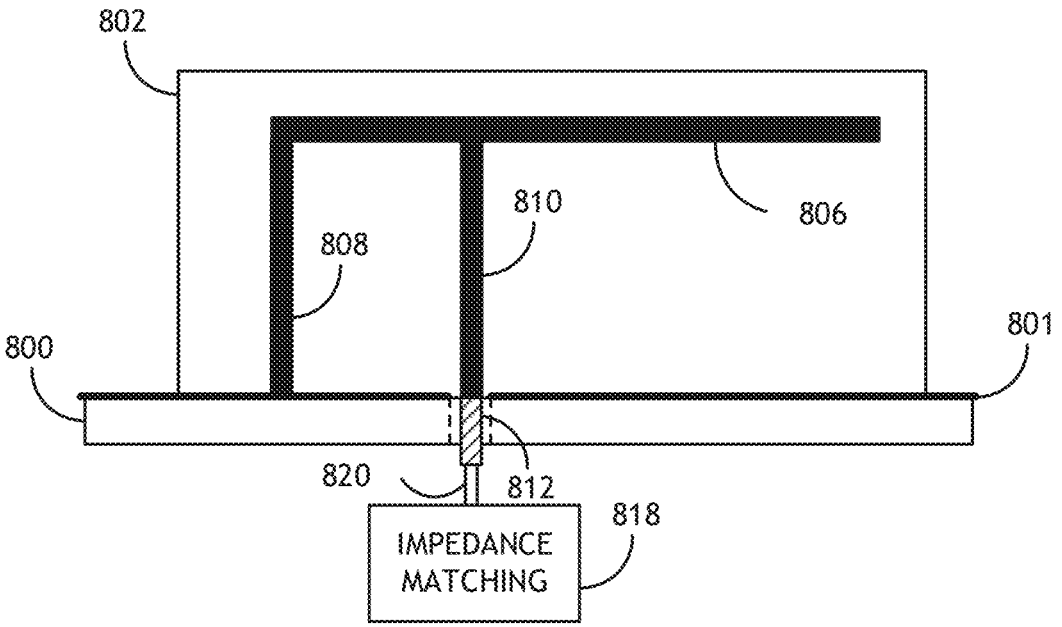
FIG. 8A shows a side view of a radiating element according to one embodiment of the inventive concepts disclosed herein.
Figure 8B:
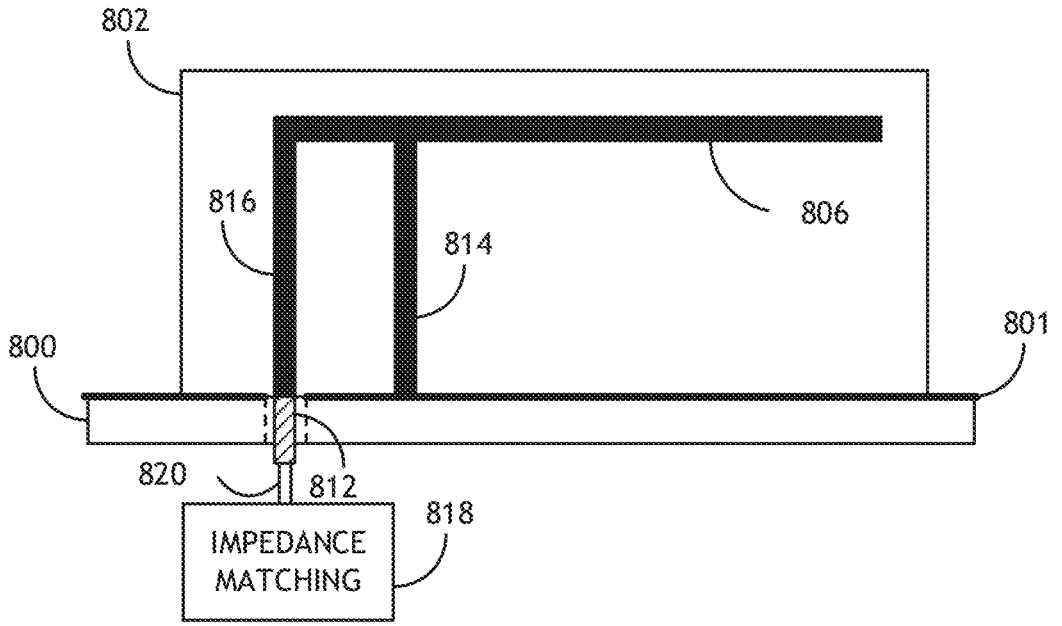
FIG. 8B shows a side view of a radiating element according to another embodiment of the inventive concepts disclosed herein.

Referring to FIGS. 8A and 8B, side views of radiating elements according to embodiments of the inventive concepts disclosed herein are shown. In one embodiment, an IFA or printed IFA 802 is connected to a substrate 800. An IFA or printed IFA 802 comprises a resonator 806 connected to a shorting element 808, 814 and a feed/radiating element 810, 816. The feed/radiating element 810, and 816 is connected to a substrate feed layer element 812 for applying signals to the resonator 806. The substrate feed layer element 812 may be a coaxial feed/radiating element, and may further be connected to a microstrip feed layer. In one embodiment, the substrate 800 is a flexible printed circuit board comprising a dielectric material and a metallic ground plane 801. In another embodiment, a metallic ground plane can be inserted between printed IFA 802 and the dielectric substrate 800 where coaxial line 820 goes through the metallic ground plane and interconnects 810 to 818.

The effective height of a small IFA or printed IFA 802 (monopole length less than $\lambda/8$) is mostly defined by the feed/radiating element 810, and 816, and the feed layer element 812, which generally contributes to radiation resistance (e.g. 50 ohms).

In at least one embodiment, each substrate feed layer element 812 is connected to a feed layer through a impedance matching element 818 configured to deliver current to the substrate feed layer element 812 and provide impedance matching. Further, the IFA or printed IFA 802 may comprise an impedance-matched perpendicular transition 820 from the feed/radiating element 810 to the impedance matching element 818. Where an antenna comprises a plurality of radiating elements that are LP scaled, impedance matching elements 818 connected to the plurality of radiating elements may also be LP scaled. The impedance matching element 818 and perpendicular transition 820 are integrated into the microstrip, stripline, coplanar waveguide (and other types or planar transmission line) that feeds the impedance match and perpendicular transition. This subassembly comprised the LP "unit cell" that is tau scale in accordance to LP theory.

Radiating elements according to embodiments of the present disclosure may be Tau scalable in accordance with log periodic antenna theory. For example, in one embodiment comprising a plurality of printed IFAs 802, configured with a Tau of approximately 0.894 and a return loss less than −10 dB in the frequency range of approximately 0.9 GHz to 2.69 GHz.

Figure 9:
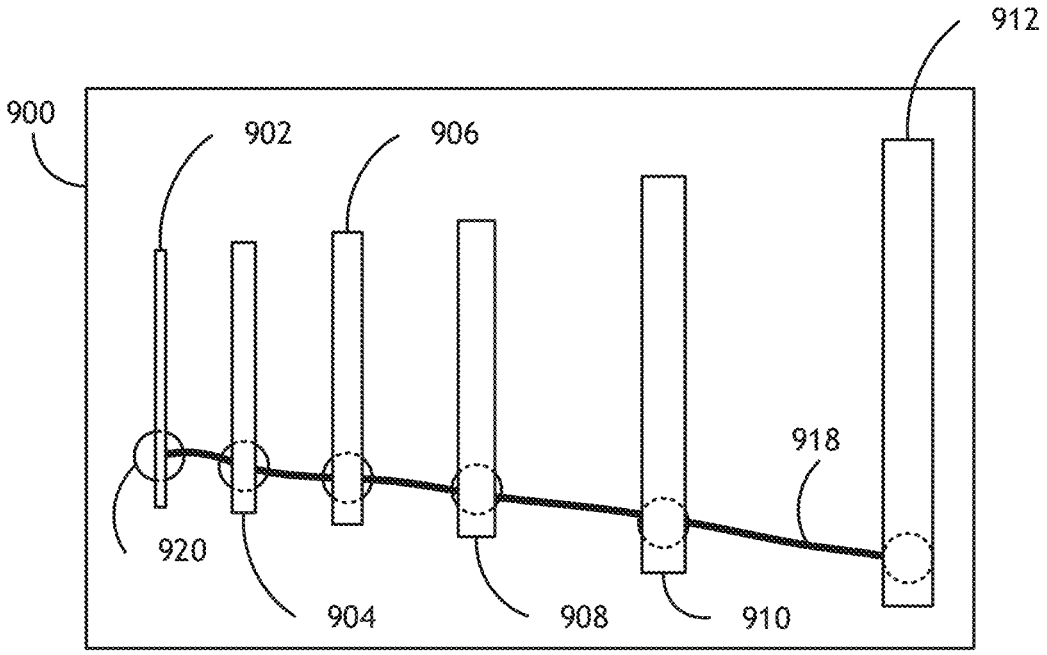
FIG. 9 shows a top view of a substrate and radiating element cards suitable for implementing embodiments of the inventive concepts disclosed herein.

Referring to FIG. 9, a top view of a substrate 900 and radiating element cards 902, 904, 906, 908, 910, and 912 suitable for implementing embodiments of the inventive concepts disclosed herein is shown. Each radiating element card 902, 904, 906, 908, 910, and 912 comprises a printed IFA connected to a substrate feed layer element 820. The radiating element cards 902, 904, 906, 908, 910, and 912 may increase in size from a smallest element 902 to a largest element 918 as defined by sectors in a flexible antenna; furthermore, the distance between neighboring radiating element cards 902, 904, 906, 908, 910, and 912 may increase according to a LP scaling factor. The radiating element cards 902, 904, 906, 908, 910, and 912 may define concentric regions of the flexible antenna. A person skilled in the art may appreciate that each radiating element card 902, 904, 906, 908, 910, and 912 may be connected to a distinct substrate feed layer element 820, with each substrate feed layer element 820 connected to a feed line 918 (microstrip or strip line, etc.) as necessary. The substrate feed layer element 820 may comprise a coaxial feed.

Figure 10:
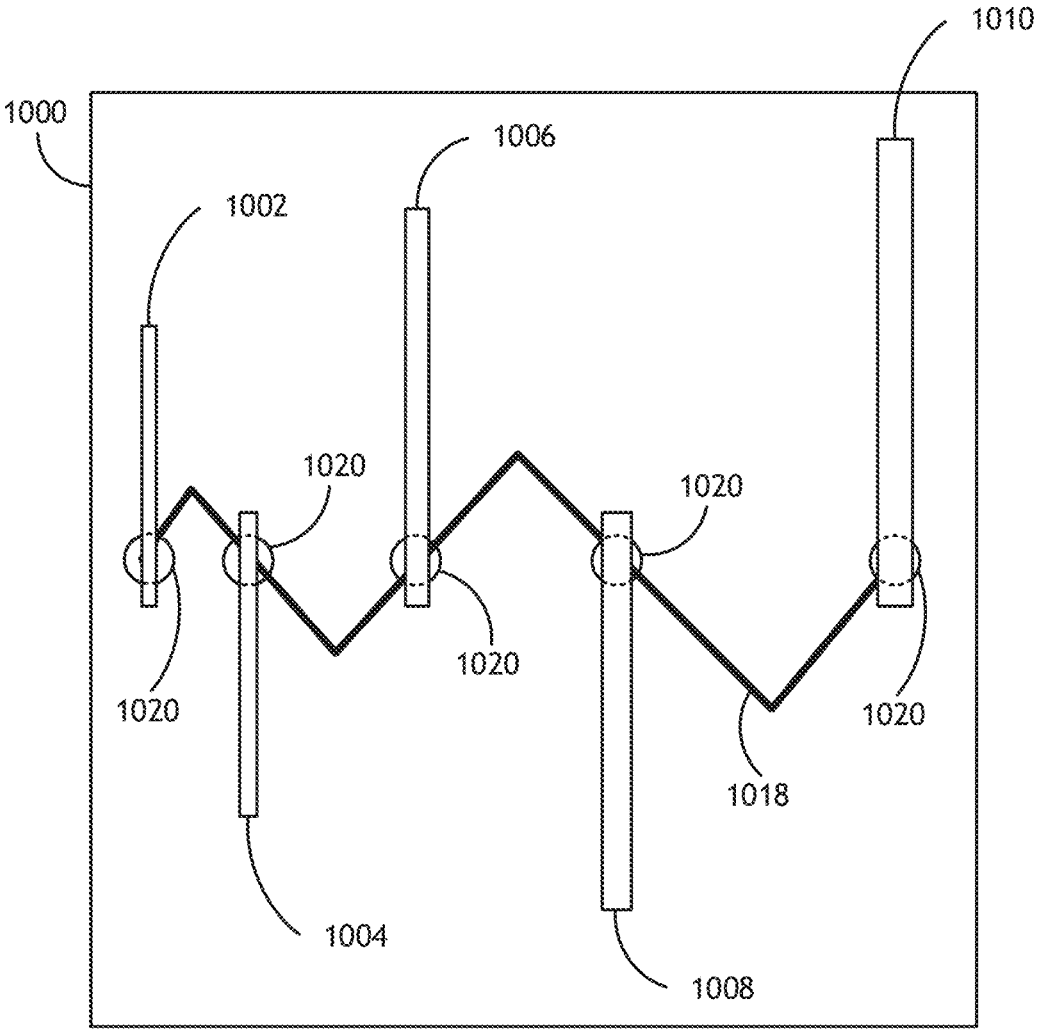
FIG. 10 shows a top view of a substrate and radiating element cards suitable for implementing embodiments of the inventive concepts disclosed herein.

Referring to FIG. 10, a top view of a substrate 1000 and radiating element cards 1002, 1004, 1006, 1008, and 1010 suitable for implementing embodiments of the inventive concepts disclosed herein is shown. Each radiating element card 1002, 1004, 1006, 1008, and 1010 comprises a printed IFA connected to a substrate feed layer element 1020 such as a coaxial feed. The radiating element cards 1002, 1004, 1006, 1008, and 1010 may be offset from neighboring radiating element cards 1002, 1004, 1006, 1008, and 1010. The radiating element cards 1002, 1004, 1006, 1008, and 1010 may increase in size from a smallest element 1002 to a largest element 1018 as defined by sectors in a flexible antenna, and the distance between radiating element cards 1002, 1004, 1006, 1008, and 1010 may increase, according to a LP scaling factor. A person skilled in the art may appreciate that each radiating element card 1002, 1004, 1006, 1008, and 1010 may be connected to a feed layer through a distinct substrate feed layer element 1020 as necessary. Furthermore, each substrate feed layer element 1020 may be connected via a feed line 1018; the feed line increasing in length between radiating element cards 1002, 1004, 1006, 1008, and 1010 according to a LP scaling factor as related to decreasing frequency of the corresponding radiating element card 1002, 1004, 1006, 1008, and 1010. In order to achieve the LP scaling factor in the feed line 1018, different shapes of feed lines 1018 may be utilized. The offset radiating element card 1002, 1004, 1006, 1008, and 1010 layout facilitates a compact physical antenna array while maintaining broadband electrical performance. This configuration also minimizes parasitic mutual coupling between the radiating elements for improved wide band performance.

Figure 11:
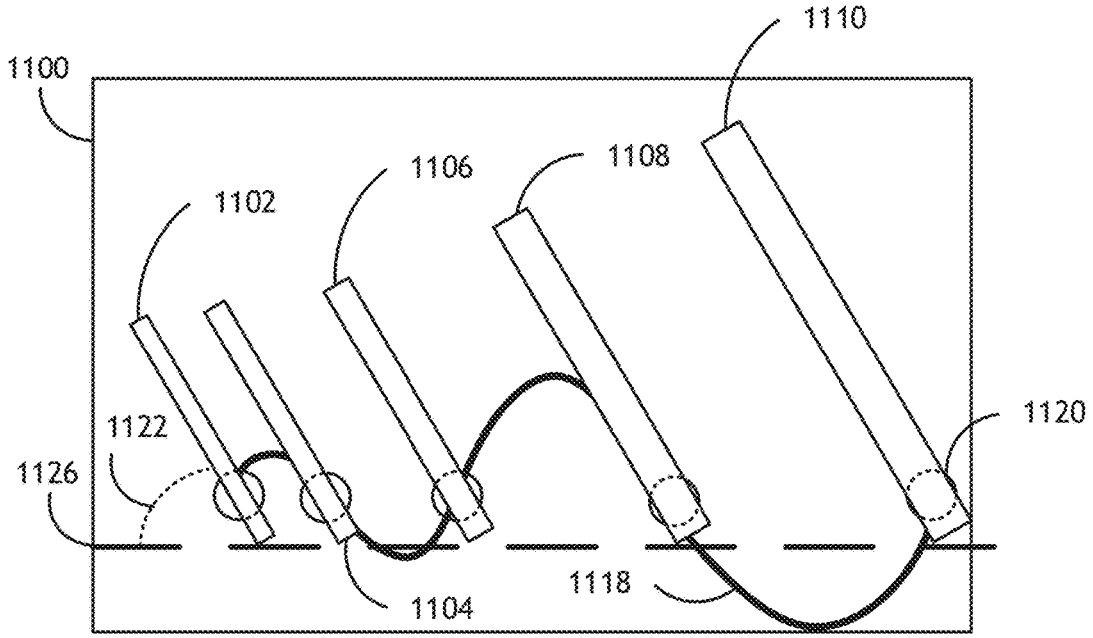
FIG. 11 shows a top view of a substrate and radiating element cards suitable for implementing embodiments of the inventive concepts disclosed herein.

Referring to FIG. 11, a top view of a substrate 1100 and radiating element cards 1102, 1104, 1106, 1108, and 1110 suitable for implementing embodiments of the inventive concepts disclosed herein is shown. Each radiating element card 1102, 1104, 1106, 1108, and 1110 comprises a printed IFA connected to a substrate feed layer element 1120. The radiating element cards 1102, 1104, 1106, 1108, and 1110 may increase in size from a smallest element 1102 to a largest element 1118 as defined by sectors in a flexible antenna. The radiating element cards 1102, 1104, 1106, 1108, and 1110 may be oriented at an angle 1122 with reference to some fixed feature. For example the radiating element cards 1102, 1104, 1106, 1108, and 1110 may be oriented with reference to a line 1126 that defines the desired transmission direction, though any landmark may be suitable. The distance between radiating element cards 1102, 1104, 1106, 1108, and 1110 may increase, according to a LP scaling factor. Furthermore each radiating element card 1102, 1104, 1106, 1108, and 1110 may be connected to a distinct substrate feed layer element 1120 or sets of radiating element card 1102, 1104, 1106, 1108, and 1110 may be connected to sets of feed layer elements 1120 as necessary. Furthermore, each substrate feed layer element 1020 may be connected via a feed line 1118; the feed line increasing in length between radiating element cards 1102, 1104, 1106, 1108, and 1110 according to a LP scaling factor. In order to achieve the LP scaling factor in the feed line 1118, different shapes of feed lines 1118 may be utilized. The rotated radiating element card 1102, 1104, 1106, 1108, and 1110 layout facilitates a compact physical antenna array while maintaining broadband electrical performance.

Figure 12:
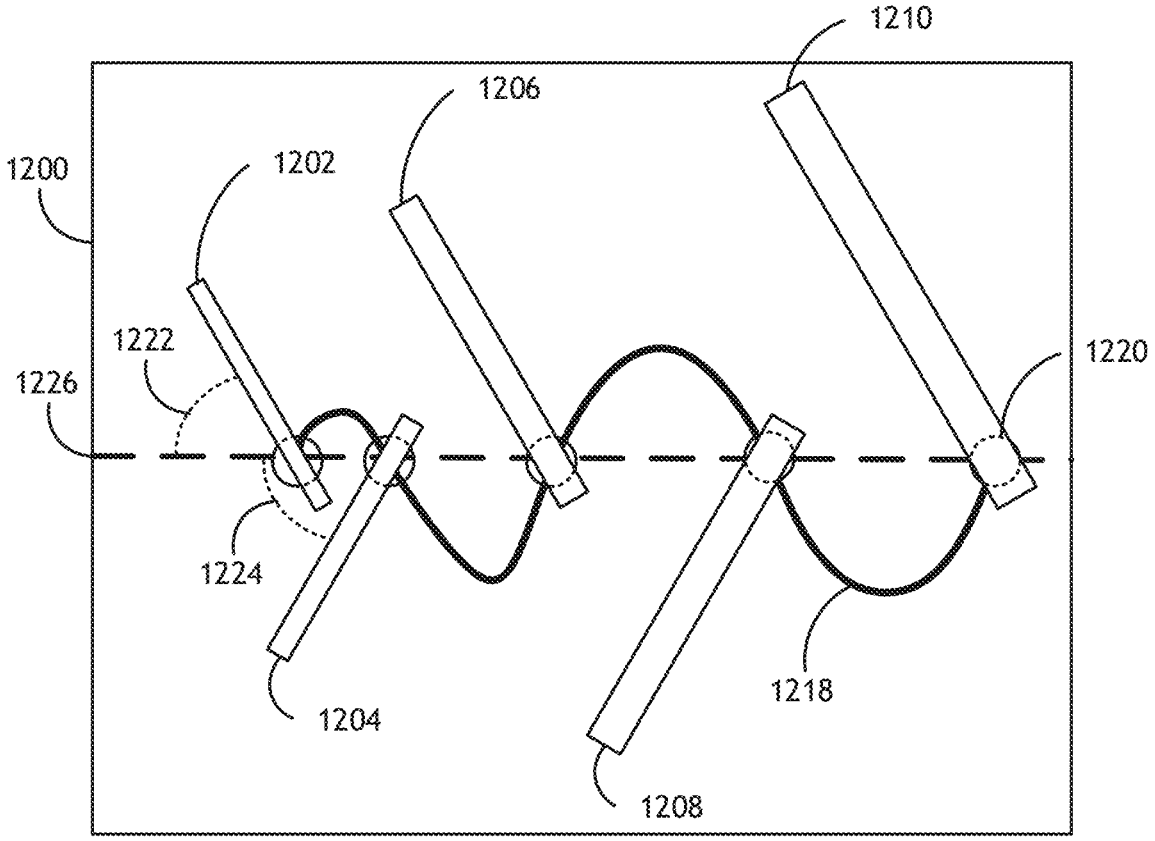
FIG. 12 shows a top view of a substrate and radiating element cards suitable for implementing embodiments of the inventive concepts disclosed herein.

Referring to FIG. 12, a top view of a substrate and radiating element cards 1202, 1204, 1206, 1208, and 1210 suitable for implementing embodiments of the inventive concepts disclosed herein is shown. Each radiating element card 1202, 1204, 1206, 1208, and 1210 comprises a printed IFA connected to a substrate feed layer element 1220. The radiating element cards 1202, 1204, 1206, 1208, and 1210 may increase in size from a smallest element 1202 to a largest element 1218 as defined by sectors in a flexible antenna. A first set of radiating element cards 1202, 1206, and 1210 may be oriented at a first angle 1222 with reference to some fixed feature. A second set of radiating element cards 1204, and 1208 may be oriented at a second angle 1224 with reference to some fixed feature. FIG. 12 shows the first and second angles 1222, and 1224 with reference to a line 1226 that defines the desired transmission direction, though landmark may be suitable. The first angle 1222 and second angle 1224 may be equal in magnitude. In another embodiment, the first angle 1222 and second angle 1224 may be independently adjusted across the entire array to produce a desired radiation pattern, or optimize the radiation pattern for a particular application. Furthermore, each radiating element card 1202, 1204, 1206, 1208, and 1210 may be connected to a distinct substrate feed layer element 1220 as necessary. Furthermore, each substrate feed layer element 1220 may be connected via a feed line 1218; the feed line increasing in length between radiating element cards 1202, 1204, 1206, 1208, and 1210 according to a LP scaling factor. In order to achieve the LP scaling factor in the feed line 1218, different shapes of feed lines 1218 may be utilized. The rotated radiating element card 1202, 1204, 1206, 1208, and 1210 layout facilitates a compact physical antenna array while maintaining broadband electrical performance.

Referring to FIG. 13, a side view of a radiating element according to another embodiment of the inventive concepts disclosed herein is shown. In one embodiment, a half-loop antenna 1306 is connected to a substrate 1300; in one embodiment, the substrate 1300 comprises a ground plane and the half-loop antenna 1306 is short circuited to the ground plane through a dielectric material. A half-loop antenna 1306 comprises a wire segment curved panel connected to a substrate feed layer element 1312 for applying signals to the half-loop antenna 1306. The substrate feed layer element 1312 may be a portion of a microstrip feed layer. In one embodiment, the substrate 1300 is a flexible printed circuit board with the substrate feed layer element 1312 printed onto the substrate 1300.

Referring to FIG. 14, a top view of an array 1400 of radiating elements 1404 according to one embodiment of the inventive concepts disclosed herein is shown. The array 1400 comprises a flexible printed circuit board microstrip layer 1402. A flexible printed circuit board microstrip layer 1402 may have a dielectric constant of 4.8 or less. Each radiating element 1404 includes a substantially rigid microstrip radiating element 1406 connected to the flexible printed circuit board microstrip layer 1402. Having the radiating element 1404 separate from the printed circuit board feed may enable increased flexibility in the array design process because the radiating element 1404 can comprise different materials as compared to the feed transmission line or ground plane structure, e.g. materials having different dielectric constants or other properties. Radiating elements 1404 may vary in size according to a desired radiating pattern; in at least one embodiment, each radiating element 1404 varies in size as compared to the preceding radiating element 1404 by some factor (Tau) such as a factor of 0.952. In one embodiment, the radiating elements 1404 are configured to produce a 1.6:1 bandwidth and operate in a frequency range between 2.04 GHz and 3.3 GHz. An antenna according to embodiments of the present disclosure may have less than −8.5 dB return loss and a 3:1 voltage standing wave ratio.

LP compatible radiating elements 1404 have properties such as Tau scalability, a cardioid radiating pattern, attractive impedance bandwidth, and are readily embodied as a puck where the radiating element is encased in dielectric material.

Some elements, such as microstrip patch derivatives and C-disk antenna radiating elements 1404, can be monolithically fabricated as a multi-layer flexible PCB. An array 1400 comprising such elements may have reduced structural stiffness. Locally rigid radiating elements 1404 mounted on the flexible PCB feed layer allow high electrical performance with a flexible feed assembly.

Figure 15:
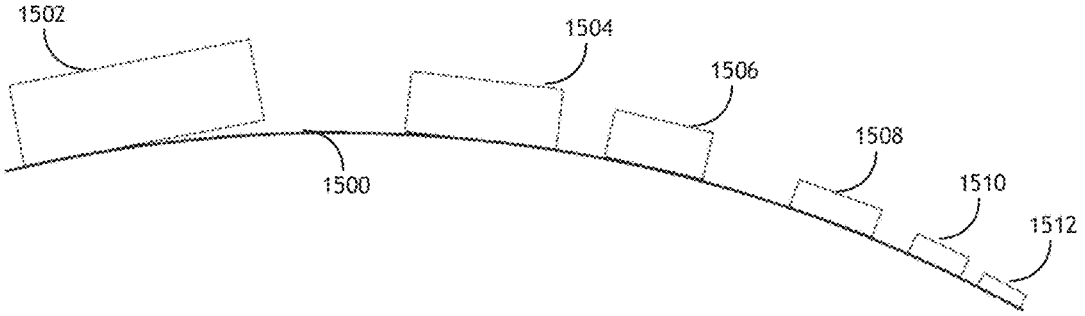
FIG. 15 shows a side view of an array of radiating elements according to one embodiment of the inventive concepts disclosed herein.

Referring to FIG. 15, a side view of an array of radiating elements 1502, 1504, 1506, 1508, 1510, and 1512 according to one embodiment of the inventive concepts disclosed herein is shown. In one embodiment, the array is a LP linear array of radiating elements 1502, 1504, 1506, 1508, 1510, and 1512. Each radiating elements 1502, 1504, 1506, 1508, 1510, and 1512 may differ in size from neighboring radiating elements 1502, 1504, 1506, 1508, 1510, and 1512 by a Tau scaling factor. Each of the radiating elements 1502, 1504, 1506, 1508, 1510, and 1512 is affixed to a flexible feed layer 1500. The flexible feed layer 1500 may comprise a flexible printed circuit board configured to conform to a mounting surface such as the surface of a vehicle. An array according to such embodiment would be locally rigid due to the rigid radiating elements 1502, 1504, 1506, 1508, 1510, and 1512 but globally flexible due to the flexible feed layer 1500.

Radiating elements according to embodiments of the present disclosure may be Tau scalable. For example, in one embodiment comprising an array configured with a Tau of approximately 0.952, the antenna may have a return loss less than −8.5 dB in the frequency range of approximately 2.04 GHz to 3.3 GHz.

Figure 16:
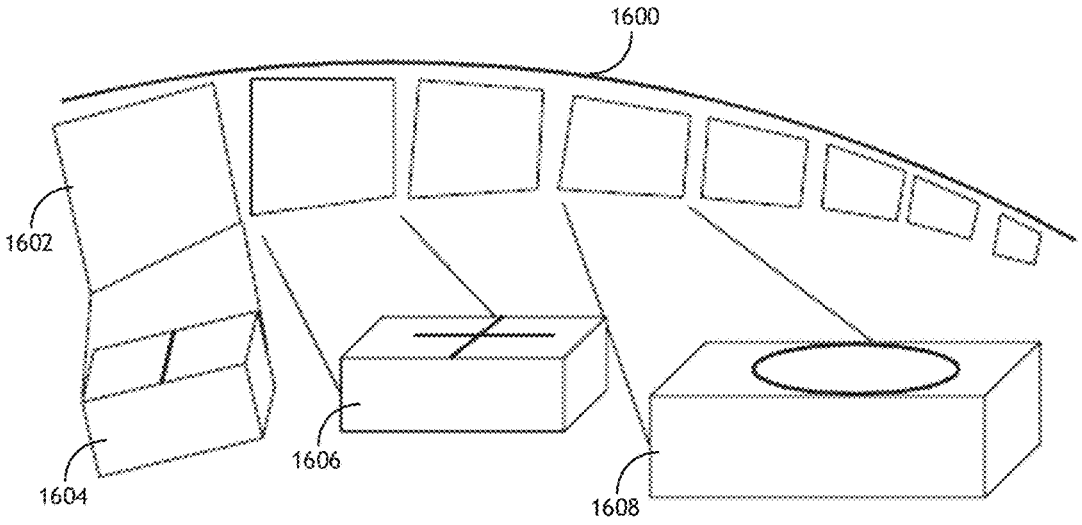
FIG. 16 shows a side view of an array of radiating elements according to one embodiment of the inventive concepts disclosed herein.

Referring to FIG. 16, a side view of an array of radiating elements 1602, 1604, 1606, and 1608 according to one embodiment of the inventive concepts disclosed herein is shown. The radiating element's cavities are recessed under the local ground structure that the antenna is integrated into, i.e., the hood or fender of a ground vehicle or the fuselage of an aircraft. In one embodiment, the array is a LP slot array of radiating elements 1602, 1604, 1606, and 1608. Each of the radiating elements 1602, 1604, 1606, and 1608 is a cavity radiating element 1602, 1604, 1606, and 1608 mounted to a common ground plane on a curved surface. The cavity radiating elements 1602, 1604, 1606, and 1608 may differ in size neighboring radiating elements 1602, 1604, 1606, and 1608 by a Tau scaling factor. Furthermore, the radiating elements 1602, 1604, 1606, and 1608 may comprise slot cavity elements 1604, crossed slot cavity elements 1608, annular ring cavity elements 1608 or any other variant of cavity radiating element 1602, 1604, 1606, and 1608. In one embodiment, the radiating elements 1602, 1604, 1606, and 1608 comprise a single type of cavity radiating element; in another embodiment, the radiating elements 1602, 1604, 1606, and 1608 comprise a mixture of different types of cavity radiating elements 1602, 1604, 1606, and 1608. This array configuration can more generally utilize any type of cavity backed element, i.e., cavity backed spiral antennas, cavity backed crossed dipoles, etc.

Each of the radiating elements 1602, 1604, 1606, and 1608 is fed by a flexible PCB feed layer connected to the radiating element 1602, 1604, 1606, and 1608 at a surface distal to the ground plane such that each radiating element 1602, 1604, 1606, and 1608 is attached to the ground plane on a bottom surface and to the flexible PCB feed layer on a top surface. Cavity radiating elements 1602, 1604, 1606, and 1608 maybe material or metamaterial loaded to minimize cavity dimensions and reduce scattering. Metamaterial based slot elements that do not require cavity backing, or that utilize "thin" material load cavity backing are envisioned. The cavity region of radiating elements 1602 through 1608 may be recessed into the vehicular surface.

An antenna array according to embodiments of the inventive concepts disclosed herein is electrically small and has high gain and attractive a desirable radiation pattern. Furthermore, distributed Tx and Rx amplification is possible within the array. Also, in some embodiments, the antenna array may be operable in at least the L band.

LP arrays according to embodiments of the inventive concepts disclosed herein have lower profile than conventional arrays configured to operate at a similar bandwidth. Furthermore, antenna arrays according to embodiments of the inventive concepts disclosed herein are conformable to a curved surface such as a vehicle, and exhibit superior low elevation angle (close to the horizon) radiation characteristics.

It is believed that the inventive concepts disclosed herein and many of their attendant advantages will be understood by the foregoing description of embodiments of the inventive concepts disclosed herein, and it will be apparent that various changes may be made in the form, construction, and arrangement of the components thereof without departing from the broad scope of the inventive concepts disclosed herein or without sacrificing all of their material advantages. The form herein before described being merely an explanatory embodiment thereof, it is the intention of the following claims to encompass and include such changes.

What is claimed is:

1. An antenna comprising:
- a flexible feed layer configured to conform to a surface; and
- a plurality of rigid radiating elements connected to the flexible feed layer, each of the plurality of rigid radiating elements comprising:
  - a ground plane;
  - a dielectric substrate disposed on the ground plane; and
  - a radiator connected to the ground plane and the flexible feed layer, wherein:
- the plurality of rigid radiating elements are organized into a log periodic (LP) array of concentric circles having an active boundary region, rigid radiating elements from an inner radius of the active boundary region to an outer radius of the active boundary region defining a stepped impedance.

2. The antenna of claim 1, wherein each of the plurality of rigid radiating elements comprises a cavity-backed radiating element.

3. The antenna of claim 2, wherein the plurality of rigid radiating elements comprises:
- a first set of radiating elements comprising a first type of cavity of radiating elements; and
- a second set of radiating elements comprising a second type of cavity of radiating elements.

4. The antenna of claim 1, wherein a lower frequency boundary of the active region is defined by a size of a first set of radiating elements, and an upper frequency boundary of the active region is defined by a size of a second set of radiating elements, wherein the first set of radiating elements is larger than the second set of radiating elements, and the active region moves across the array in a log periodic fashion.

5. The antenna of claim 4, wherein each of the plurality of rigid radiating elements comprise a C-disk element.

6. The antenna of claim 4, wherein each of the plurality of rigid radiating elements comprise a printed inverted F antenna.

7. The antenna of claim 4, wherein each of the plurality of rigid radiating elements is connected to the feed layer via a serpentine feed line, the length of the serpentine feed line between each of the plurality of rigid radiating elements corresponding to a LP scaling factor.

8. A vehicle comprising:

an antenna comprising:
- a flexible feed layer configured to conform to a surface; and
- a plurality of rigid radiating elements connected to the flexible feed layer, each of the plurality of rigid radiating elements comprising:
  - a ground plane;
  - a dielectric substrate disposed on the ground plane; and
  - a radiator connected to the ground plane and the flexible feed layer, wherein:
- the plurality of rigid radiating elements are organized into a log periodic (LP) array of concentric circles having an active region, rigid radiating elements from an inner radius of the active region to an outer radius of the active region defining a stepped impedance.

9. The vehicle of claim 8, wherein each of the plurality of rigid radiating elements comprises a cavity-backed radiating element.

10. The vehicle of claim 8, wherein the plurality of rigid radiating elements comprises:

a first set of radiating elements comprising a first type of cavity of radiating elements; and a second set of radiating elements comprising a second type of cavity of radiating elements.

11. The vehicle of claim 8, wherein a lower frequency boundary of the active region is defined by a size of a first set of radiating elements, and an upper frequency boundary of the active region is defined by a size of a second set of radiating element radiating elements, wherein the first set of radiating elements is larger than the second set of radiating elements, and the active region moves across the array in a log periodic fashion.

12. The vehicle of claim 8, wherein each of the plurality of rigid radiating elements comprise an inverted F antenna.

13. The vehicle of claim 8, wherein each of the plurality of rigid radiating elements comprise a planar inverted F antenna.

14. An antenna array comprising:

a flexible feed layer configured to conform to a surface; and a plurality of rigid radiating elements connected to the flexible feed layer, each of the plurality of rigid radiating elements comprising:

a ground plane;

a dielectric substrate disposed on the ground plane; and a radiator connected to the ground plane and the flexible feed layer, wherein:

the plurality of rigid radiating elements are organized into a log periodic (LP) array of concentric circles having an active region, rigid radiating elements from an inner radius of the active boundary region to an outer radius of the active region defining a stepped impedance; and concentric circles defining sectors, each sector corresponding to a portion of a horizon.

15. The antenna array of claim 14, wherein a lower frequency boundary of the active region is defined by a size of a first set of radiating elements, and an upper frequency boundary of the active region is defined by a size of a second set of radiating element radiating elements, wherein the first set of radiating elements is larger than the second set of radiating elements, and the active region moves across the array in a log periodic fashion.

16. The antenna array of claim 14, wherein each of the plurality of rigid radiating elements comprises a multi-arm inverted F puck.

17. The antenna array of claim 14, wherein each of the plurality of rigid radiating elements comprise an inverted F antenna.

18. The antenna array of claim 14, wherein each of the plurality of rigid radiating elements comprise a planar inverted F antenna.

19. The antenna array of claim 14, wherein the plurality of rigid radiating elements comprises:

a first set of radiating elements configured to receive signals; and a second set of radiating elements configured to transmit signals.

20. The antenna array of claim 14, wherein each of the plurality of rigid radiating elements is connected to the feed layer via a feed line, the length of the feed line between each of the plurality of rigid radiating elements corresponding to a LP scaling factor.

* * * * *